US008491257B2

(12) United States Patent
Martin et al.

(10) Patent No.: US 8,491,257 B2
(45) Date of Patent: Jul. 23, 2013

(54) NOZZLE VANE AND CRANK ARM ASSEMBLY AND METHOD

(75) Inventors: Steven P. Martin, Walnut, CA (US); Christopher O. Meade, Redondo Beach, CA (US); Patrick A. Rayner, Lomita, CA (US)

(73) Assignee: Honeywell International Inc., Morristown, NJ (US)

( * ) Notice: Subject to any disclaimer, the term of this patent is extended or adjusted under 35 U.S.C. 154(b) by 491 days.

(21) Appl. No.: 12/746,779

(22) PCT Filed: Dec. 11, 2008

(86) PCT No.: PCT/US2008/086382

§ 371 (c)(1), (2), (4) Date: Jun. 8, 2010

(87) PCT Pub. No.: WO2009/076508

PCT Pub. Date: Jun. 18, 2009

(65) Prior Publication Data

US 2010/0254815 A1 Oct. 7, 2010

Related U.S. Application Data

(60) Provisional application No. 61/013,017, filed on Dec. 12, 2007.

(51) Int. Cl.
*F01D 17/16* (2006.01)

(52) U.S. Cl.
USPC ..... 415/163

(58) Field of Classification Search
USPC ..... 415/160, 163, 164, 165; 403/1, 359.5, 403/DIG. 7
See application file for complete search history.

(56) References Cited

U.S. PATENT DOCUMENTS 2,862,654 A 12/1958 Gardiner
3,030,072 A * 4/1962 Boyd ..... 415/164

(Continued)

FOREIGN PATENT DOCUMENTS

DE 2 113 194 * 9/1972
EP 1 156 227 A2 11/2001

OTHER PUBLICATIONS

International Preliminary Report on Patentability for International Application No. PCT/US2008/086382 mailed Jun. 24, 2010.

*Primary Examiner* — Edward Look
*Assistant Examiner* — William Grigos
(74) *Attorney, Agent, or Firm* — Alston & Bird LLP

(57) ABSTRACT

A method of assembling a crank arm (100, 200, 300) and vane assembly for a variable nozzle without requiring metallurgical bonding. In accordance with one aspect of the invention, the method comprises the steps of providing a vane assembly comprising a vane (120, 220, 320) joined to a vane shaft (110, 210, 310) that extends from the vane and terminates in a distal end (112, 212, 312), providing a recess (114, 214, 314) in an outer surface of the vane shaft at a location between the vane and the distal end, providing a crank arm (100, 200, 300) having an aperture (102, 202, 302) therein, inserting the distal end (112, 212, 312) of the vane shaft into the aperture (102, 202, 302) until the recess (114, 214, 314) in the vane shaft is inside the aperture, and causing a retaining member (104, 204, 304) associated with the crank arm (100, 200, 300) to engage the recess (114, 214, 314) in such a manner as to fasten the crank arm to the vane shaft in a substantially immovable manner.

5 Claims, 3 Drawing Sheets

U.S. PATENT DOCUMENTS 3,850,544 A 11/1974 Ciokajlo
4,299,534 A 11/1981 Yamane et al.
4,437,782 A * 3/1984 Geisthoff ..... 403/13
5,492,446 A 2/1996 Hawkins et al.
5,873,700 A 2/1999 Ichikawa
2002/0083799 A1* 7/2002 Albertson ..... 81/59.1
2002/0119041 A1* 8/2002 Jinnai et al. ..... 415/160
2002/0168262 A1* 11/2002 Jinnai ..... 415/164
2005/0232715 A1* 10/2005 Baumann et al. ..... 408/226
2007/0172348 A1* 7/2007 Battig ..... 415/160

* cited by examiner

NOZZLE VANE AND CRANK ARM ASSEMBLY AND METHOD

BACKGROUND OF THE INVENTION

The present disclosure relates generally to a variable nozzle for a turbocharger, wherein a plurality of vanes are each respectively connected to a crank arm that can be rotated one direction or another by an actuation mechanism, such that the vanes are varied in angle in order to vary the flow through the nozzle.

In a conventional variable nozzle of the above-noted type, the crank arms are attached to the vanes by metallurgical bonding such as welding or brazing. This process is susceptible to variabilities, is awkward to perform because of the small sizes of the parts in a typical turbocharger nozzle, and can be expensive.

Additionally, in some cases the vane part to which the crank arm must be connected is non-metallic, such as ceramic. In these cases, metallurgical bonding is not possible.

BRIEF SUMMARY OF THE DISCLOSURE

This disclosure relates to an alternative method of attaching a crank arm to a vane shaft without requiring metallurgical bonding. In accordance with one aspect of the invention, a method of assembling a crank arm and vane assembly for a variable nozzle comprises the steps of providing a vane assembly comprising a vane joined to a vane shaft that extends from the vane and terminates in a distal end; providing at least one recess in an outer surface of the vane shaft at a location between the vane and the distal end; providing a crank arm having an aperture therein; inserting the distal end of the vane shaft into the aperture until the at least one recess in the vane shaft is inside the aperture; and causing at least one retaining member associated with the crank arm to engage the at least one recess in such a manner as to fasten the crank arm to the vane shaft in a substantially immovable manner. In some embodiments, the vane shaft has a single recess for receiving a single retaining member; in other embodiments, the vane shaft can have a plurality of recesses for respectively receiving a plurality of retaining members.

In one embodiment, a portion of the crank arm is formed as a resilient spring clip that in its relaxed condition projects partially into the aperture in the crank arm. When the end of the vane shaft is inserted into the aperture, the shaft urges the spring clip radially outwardly to be flush with the inside diameter of the aperture, until the recess in the vane shaft becomes aligned with the spring clip, whereupon the spring clip springs back inwardly and engages the recess. The engagement of the spring clip in the recess substantially prevents rotational movement of the shaft about its axis and translational movement parallel to the axis relative to the crank arm.

In another embodiment, the crank arm defines a hole that extends through a wall of the crank arm into the aperture. The hole extends along a direction generally perpendicular to the axis of the aperture. The vane shaft is inserted into the aperture until the recess becomes aligned with the hole, and then a ball of steel or the like is inserted into the hole until it is partially engaged in the recess and partially engaged in the hole. The ball is slightly larger in diameter than the hole such that it must be pressed into the hole with an interference fit. The recess in the vane shaft also forms a very tight or interference fit with the ball. The engagement of the ball in the recess substantially prevents rotational movement of the shaft about its axis and translational movement parallel to the axis relative to the crank arm.

In yet another embodiment, a portion of the wall of the crank arm that surrounds the aperture is deformed or crimped after the vane shaft is inserted into the aperture such that the portion extends into the recess with a tight fit. The engagement of the crimped portion in the recess substantially prevents rotational movement of the shaft about its axis and translational movement parallel to the axis relative to the crank arm.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
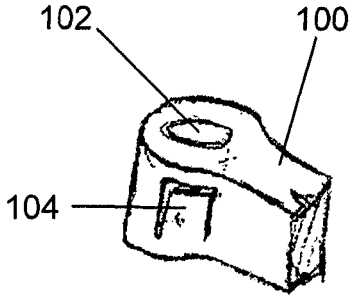
FIGS. 1A through 1D illustrate a crank arm and vane assembly in accordance with one embodiment of the invention.

A first embodiment of the invention is illustrated in FIGS. 1A through 1D. In FIG. 1A, a crank arm 100 is depicted in fragmentary form, it being understood that only the portion of interest is shown. The crank arm defines an aperture 102 therethrough. A portion of the wall of the crank arm surrounding the aperture forms a spring clip 104 that can be resiliently urged radially outwardly from its relaxed position. In the relaxed position, the spring clip 104 extends into the aperture 102.

Figure 1B:
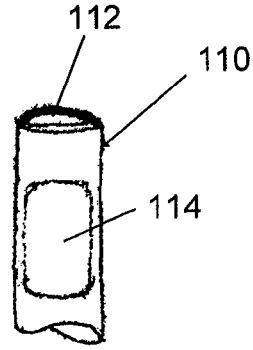
Figure 1C:
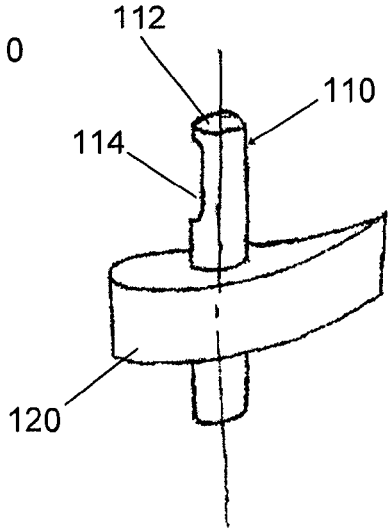

FIG. 1B shows the end portion of a vane shaft 110, and FIG. 1C shows a vane assembly comprising the vane shaft 110 joined to a vane 120. The vane shaft extends from the vane and terminates at a distal end 112. At a location between the distal end and the vane, the outer surface of the vane shaft defines a recess 114.

Figure 1D:
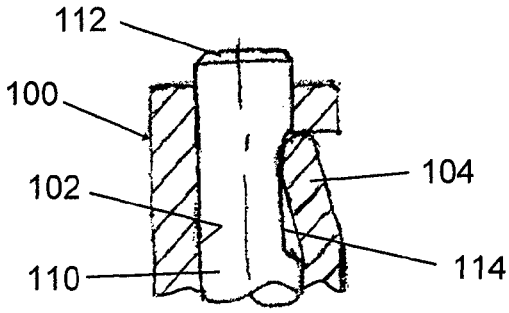

As shown in FIG. 1D, to affix the vane shaft to the crank arm, the distal end 112 of the vane shaft is inserted into the aperture 102 in the crank arm until the recess 114 becomes aligned with the spring clip 104, whereupon the spring clip springs back toward its relaxed position and engages the recess 114 in a manner substantially preventing rotational and translational movement of the vane shaft relative to the crank arm.

Figure 2A:
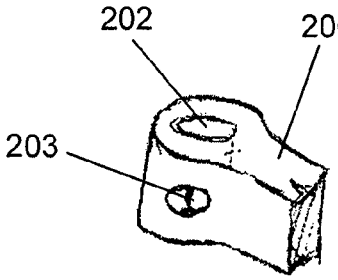
FIGS. 2A through 2D illustrate a crank arm and vane assembly in accordance with another embodiment of the invention.

A second embodiment is illustrated in FIGS. 2A through 2D. In FIG. 2A, a crank arm 200 is depicted in fragmentary form, it being understood that only the portion of interest is shown. The crank arm defines an aperture 202 therethrough. A portion of the wall of the crank arm surrounding the aperture has a hole 203 formed through it. The hole 203 extends along a direction generally perpendicular to the axis of the aperture, and extends into the aperture.

Figure 2B:
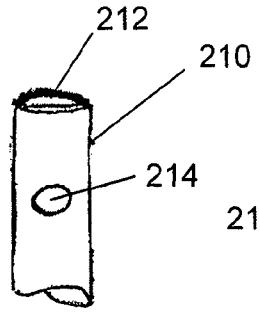
Figure 2C:
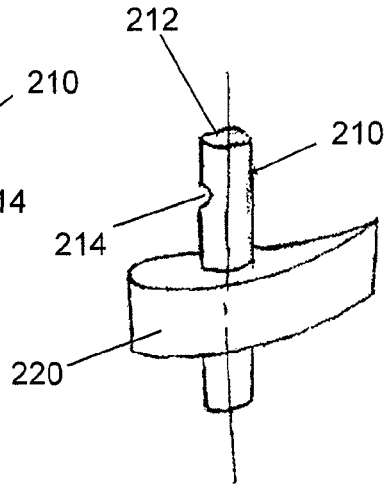

FIG. 2B shows the end portion of a vane shaft 210, and FIG. 2C shows a vane assembly comprising the vane shaft 210 joined to a vane 220. The vane shaft extends from the vane and terminates at a distal end 212. At a location between the distal end and the vane, the outer surface of the vane shaft defines a recess 214.

Figure 2D:
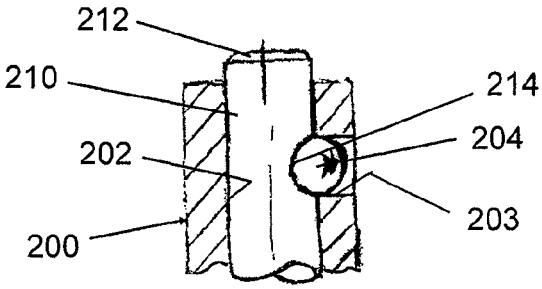

As shown in FIG. 2D, to affix the vane shaft to the crank arm, the distal end 212 of the vane shaft is inserted into the aperture 202 in the crank arm until the recess 214 becomes aligned with the hole 203 in the crank arm wall. Then, a ball 204 of steel or other suitable material is pressed into the hole 203 until the ball seats into the recess 214 in the vane shaft in a manner substantially preventing rotational and translational movement of the vane shaft relative to the crank arm. The ball's diameter is slightly larger than the diameter of the hole 203 such that an interference fit exists therebetween to prevent the ball from being dislodged in operation.

Figure 3A:
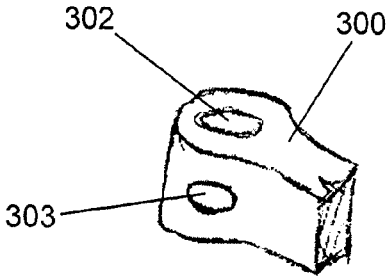
FIGS. 3A through 3E illustrate a crank arm and vane assembly in accordance with yet another embodiment of the invention.

A third embodiment is illustrated in FIGS. 3A through 3D. In FIG. 3A, a crank arm 300 is depicted in fragmentary form, it being understood that only the portion of interest is shown. The crank arm defines an aperture 302 therethrough. A portion of the wall of the crank arm surrounding the aperture has a marking or indication 303 formed thereon to signify a location at which the wall portion will subsequently be crimped as described below.

Figure 3B:
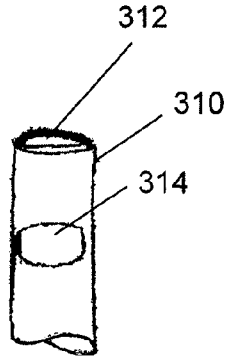
Figure 3C:
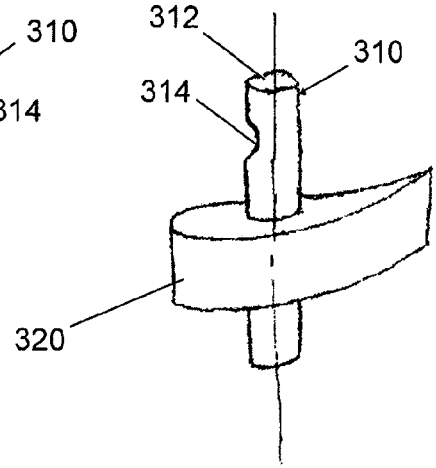

FIG. 3B shows the end portion of a vane shaft 310, and FIG. 3C shows a vane assembly comprising the vane shaft 310 joined to a vane 320. The vane shaft extends from the vane and terminates at a distal end 312. At a location between the distal end and the vane, the outer surface of the vane shaft defines a recess 314.

Figure 3D:
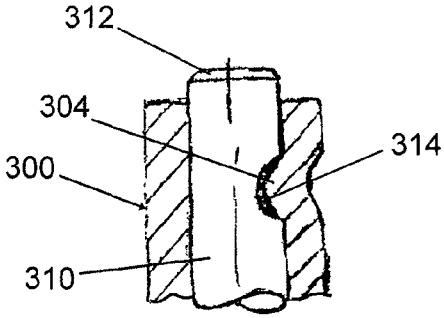

As shown in FIG. 3D, to affix the vane shaft to the crank arm, the distal end 312 of the vane shaft is inserted into the aperture 302 in the crank arm until the recess 314 becomes aligned with the indication 303 on the crank arm wall. Then, a portion 304 of the crank arm wall corresponding to the indication 303 is deformed or crimped radially inwardly until the portion seats into the recess 314 in the vane shaft in a manner substantially preventing rotational and translational movement of the vane shaft relative to the crank arm.

Thus, in accordance with the invention, a purely mechanical connection (as opposed to a metallurgical bond) accomplishes the attachment of the crank arm to the vane shaft. Accordingly, the process can be used with vane shafts and/or crank arms that are non-metallic such as ceramic. The process is considerably simpler, less susceptible to variabilities, and more-repeatable than welding or brazing.

Figure 3E:
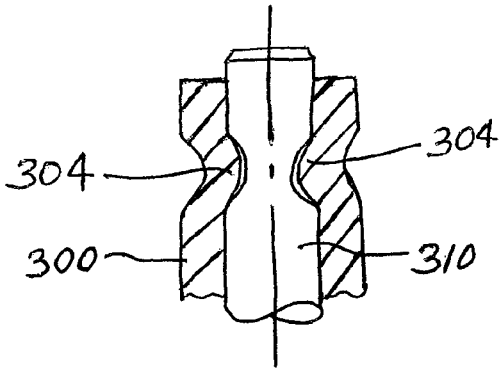

In the various embodiments as described, the aperture in the crank arm advantageously is slightly smaller than the diameter of the vane shaft such that an interference fit exists between these parts. The recess in the vane shaft is located such that a predetermined desired spatial relationship and orientation exists between the vane shaft and the crank arm. It will be understood that the relative size and/or shape of the recess in the vane shaft can be varied relative to the recess shown in the drawings. For example, the recess 114 in FIG. 1 could be altered so that it essentially matches the slope and/or shape of the spring clip 104. Additionally or alternatively, the vane shaft can have more than one recess 114, 214, 314 spaced apart circumferentially on the vane shaft, and correspondingly the crank arm can have more than one retaining member 104, 204, 304. For example, the vane shaft can have two recesses 114, 214, 314 spaced apart about 180° for receiving two retaining members 104, 204, 304 correspondingly spaced apart on the crank arm. FIG. 3E shows such a variation for the embodiment of FIGS. 3A-D.

Many modifications and other embodiments of the inventions set forth herein will come to mind to one skilled in the art to which these inventions pertain having the benefit of the teachings presented in the foregoing descriptions and the associated drawings.

Although specific terms are employed herein, they are used in a generic and descriptive sense only and not for purposes of limitation.

The invention claimed is:

1. A method of assembling a crank arm and vane assembly for a variable nozzle, comprising the steps of:

providing a vane assembly comprising a vane joined to a vane shaft that extends from the vane and terminates in a distal end;

providing a recess in an outer surface of the vane shaft at a location between the vane and the distal end;

providing a crank arm having an aperture therein;

inserting the distal end of the vane shaft into the aperture until the recess in the vane shaft is inside the aperture; and causing a retaining member associated with the crank arm to engage the recess in such a manner as to fasten the crank arm to the vane shaft in a substantially immovable manner, wherein the retaining member comprises a resiliently deformable portion of the crank arm that extends into the aperture in a relaxed condition, and the inserting step causes the resiliently deformable portion to be urged radially outwardly until the recess in the vane shaft becomes aligned with the resiliently deformable portion, whereupon the resiliently deformable portion springs back and engages the recess.

2. A method of assembling a crank arm and vane assembly for a variable nozzle, comprising the steps of:

providing a vane assembly comprising a vane joined to a vane shaft that extends from the vane and terminates in a distal end;

providing a recess in an outer surface of the vane shaft at a location between the vane and the distal end;

providing a crank arm having an aperture therein;

inserting the distal end of the vane shaft into the aperture until the recess in the vane shaft is inside the aperture; and causing a retaining member associated with the crank arm to engage the recess in such a manner as to fasten the crank arm to the vane shaft in a substantially immovable manner, wherein the causing step comprises mechanically deforming a portion of a wall of the crank arm such that said portion engages the recess in the vane shaft.

3. A crank arm and vane assembly, comprising:

a vane assembly comprising a vane joined to a vane shaft that extends from the vane and terminates in a distal end;

a recess defined in an outer surface of the vane shaft at a location between the vane and the distal end;

a crank arm having an aperture therein;

the distal end of the vane shaft extending through the aperture and the recess in the vane shaft being inside the aperture; and a retaining member associated with the crank aim engaged in the recess in such a manner as to fasten the crank arm to the vane shaft in a substantially immovable manner, wherein the retaining member comprises a resiliently deformable portion of the crank arm that extends into the aperture in a relaxed condition, the resiliently deformable portion being urged radially outwardly upon insertion of the vane shaft in the aperture until the recess in the vane shaft becomes aligned with the resiliently deformable portion, whereupon the resiliently deformable portion springs back and engages the recess.

4. The crank arm and vane assembly of claim 3, wherein there are a plurality of recesses in the vane shaft and a corresponding plurality of retaining members.

5. A crank arm and vane assembly, comprising:

a vane assembly comprising a vane joined to a vane shaft that extends from the vane and terminates in a distal end;

a recess defined in an outer surface of the vane shaft at a location between the vane and the distal end;

a crank arm having an aperture therein;

the distal end of the vane shaft extending through the aperture and the recess in the vane shaft being inside the aperture; and a retaining member associated with the crank arm engaged in the recess in such a manner as to fasten the crank arm to the vane shaft in a substantially immovable manner, wherein the retaining member comprises a mechanically deformed portion of a wall of the crank arm, said portion engaging the recess in the vane shaft.

* * * * *